US006837597B1

(12) United States Patent
Lin et al.

(10) Patent No.: US 6,837,597 B1
(45) Date of Patent: Jan. 4, 2005

(54) LAMPSHADE ASSEMBLY

(76) Inventors: Liang-An Lin, No. 33, Lane 115, Shen-Lin S. Rd., Ta-Ya Hsiang, Taichung Hsien (TW); Ching-Hui Chen, No. 33, Lane 115, Shen-Lin S. Rd., Ta-Ya Hsiang, Taichung Hsien (TW)

( * ) Notice: Subject to any disclaimer, the term of this patent is extended or adjusted under 35 U.S.C. 154(b) by 22 days.

(21) Appl. No.: 10/619,994

(22) Filed: Jul. 15, 2003

(51) Int. Cl.[7] ..... F21V 1/06

(52) U.S. Cl. ..... 362/352; 362/360; 362/358; 362/367; 362/450

(58) Field of Search ..... 362/352, 360, 362/358, 367, 450

(56) References Cited

U.S. PATENT DOCUMENTS 1,363,782 A * 12/1920 Handel ..... 362/360
3,142,446 A * 7/1964 Okamoto ..... 362/352
5,613,770 A * 3/1997 Chin et al. ..... 362/367
6,746,137 B1 * 6/2004 Yeh ..... 362/352
6,773,145 B2 * 8/2004 Yang ..... 362/352
2004/0125604 A1 * 7/2004 Yeh ..... 362/352

* cited by examiner

*Primary Examiner*—Stephen Husar
*Assistant Examiner*—Anabel Ton
(74) *Attorney, Agent, or Firm*—Frommer Lawrence & Haug LLP; Ronald R. Santucci

(57) ABSTRACT

A lampshade assembly includes a rib retaining unit and a plurality of shade members. The rib retaining unit includes a lower rib retaining member, an upper rib retaining member superimposed on the lower rib retaining member, and a fastening member for securing together the lower and upper rib retaining members. The connecting rib has a distal end retained removably on the rib retaining unit. The shade members are disposed adjacent to each other, and cooperate to form a lamp containing space when the distal ends of the connecting ribs of the shade members are retained on the rib retaining unit.

11 Claims, 9 Drawing Sheets

LAMPSHADE ASSEMBLY

BACKGROUND OF THE INVENTION

1. Field of the Invention

The invention relates to a lampshade assembly, more particularly to a lampshade assembly that can be assembled with relative ease.

2. Description of the Related Art

Referring to FIG. 1, a conventional lampshade 1 is shown to include a unitary frusta-conical shell. Since the shell is not designed to permit disassembly thereof, the lampshade 1 is bulky, thereby resulting in increased packing and transport costs.

Referring to FIGS. 2, 3, 4 and 5, in order to overcome the shortcomings of the aforesaid prior art, a conventional lampshade assembly 2 has been proposed heretofore. The lampshade assembly 2 includes a plurality of shade members 21, an anchoring member 22, a plurality of rigid covering strips 23, and a plurality of clip members 24.

The anchoring member 22 includes an upper anchoring part 221, a lower anchoring part 223, an intermediate annular part 222 mounted between the upper and lower anchoring parts 221, 223, a resilient element 224 mounted between the upper and lower anchoring parts 221, 223 and through the intermediate annular part 222, and three ribs 225 extending radially from the upper anchoring part 221, the intermediate annular part 222, and the lower anchoring part 223 respectively and connected to the upper edge of an inner side of a corresponding one of the shade members 21.

Each rigid covering strip 23 is made of metal, and includes a strip body 231 having lower and upper end portions, a hook 232 formed at the lower end portion of the strip body 231, a clip 233 pivotally mounted at the upper end portion of the strip body 231. In use, the strip bodies 231 of the covering strips 23 are disposed on outer sides of an adjacent pair of the shade members 21 to conceal side edges of the latter. The hooks 232 and the clips 233 on the covering strips 23 retain the same on the corresponding pair of shade members 21. In addition, each of the clip members 24 is generally U-shaped, and interconnects removably the side edges of an adjacent pair of the shade members 21 at the inner sides of the adjacent pair of the shade members 21.

Although the size of the conventional lampshade assembly 2 can be reduced to result in lower packaging and transport costs, it has the following shortcomings. When the conventional lampshade assembly 2 is assembled from the state shown in FIG. 3 to the state shown in FIG. 2, the upper anchoring part 221 is required to be pressed laboriously toward the lower anchoring part 223 to overcome the resilience of the resilient element 224, and to be rotated relative to the lower anchoring part 223 in order to engage anchoring hooks 227 of the upper anchoring part 221 with anchoring blocks 226 of the lower anchoring part 223. In view of the aforesaid, it is quite difficult to assemble the conventional lampshade assembly 2. Furthermore, the rigid covering strips 23 made of metal are suited for only a specific size of the shade members 21.

SUMMARY OF THE INVENTION

The object of the present invention is to provide a lampshade assembly that can be assembled with relative ease.

Accordingly, the lampshade assembly of this invention includes a rib retaining unit, and a plurality of shade members.

The rib retaining unit includes a lower rib retaining member and an upper rib retaining member superimposed on the lower rib retaining member. One of the lower and upper rib retaining members is formed with a coupling post. The other of the lower and upper rib retaining members is formed with a post hole that permits the coupling post to extend removably therethrough. The rib retaining unit has a periphery. At least one of the lower and upper rib retaining members has one side that confronts the other of the lower and upper rib retaining members and that is formed with a plurality of anchoring units. The anchoring units are disposed around the coupling post, are angularly spaced apart from each other, and configure the rib retaining unit with a plurality of anchoring grooves that extend in radial inward directions from the periphery of the rib retaining unit toward the coupling post. The rib retaining unit further includes a fastening member that engages removably the coupling post for securing together the lower and upper rib retaining members.

Each of the shade members has an outer side, an inner side opposite to the outer side in a first direction, an upper edge, a lower edge opposite to the upper edge in a second direction transverse to the first direction, and a pair of side edges extending between the upper and lower edges and opposite to each other in a third direction transverse to the first and second directions. Each of the shade members further has a connecting rib that extends in the first direction from the upper edge at the inner side. The connecting rib has a distal end retained removably on the rib retaining unit in a respective one of the anchoring grooves.

The shade members are disposed adjacent to each other. The inner sides of the shade members cooperate to form a lamp containing space when the distal ends of the connecting ribs of the shade members are retained on the rib retaining unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
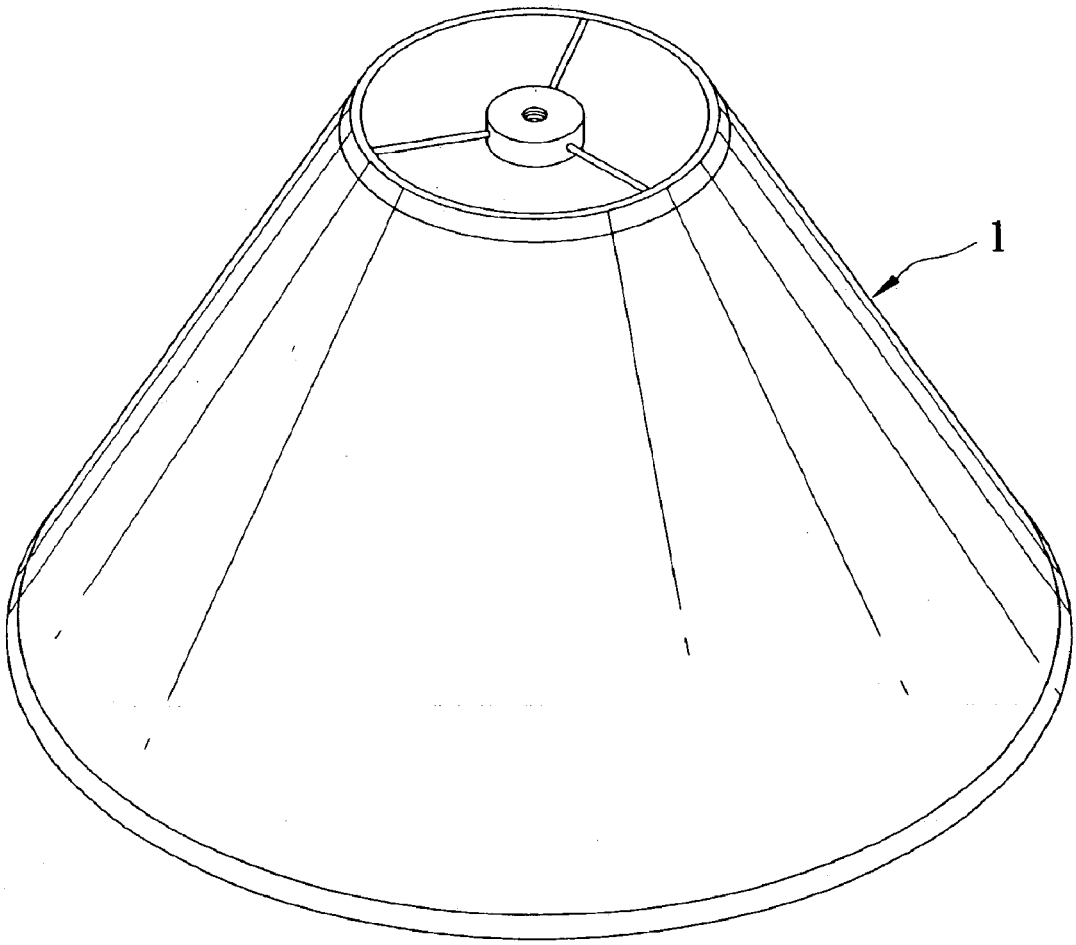
FIG. 1 PRIOR ART
FIG. 1 is a perspective view of a conventional lampshade.
Figure 2:
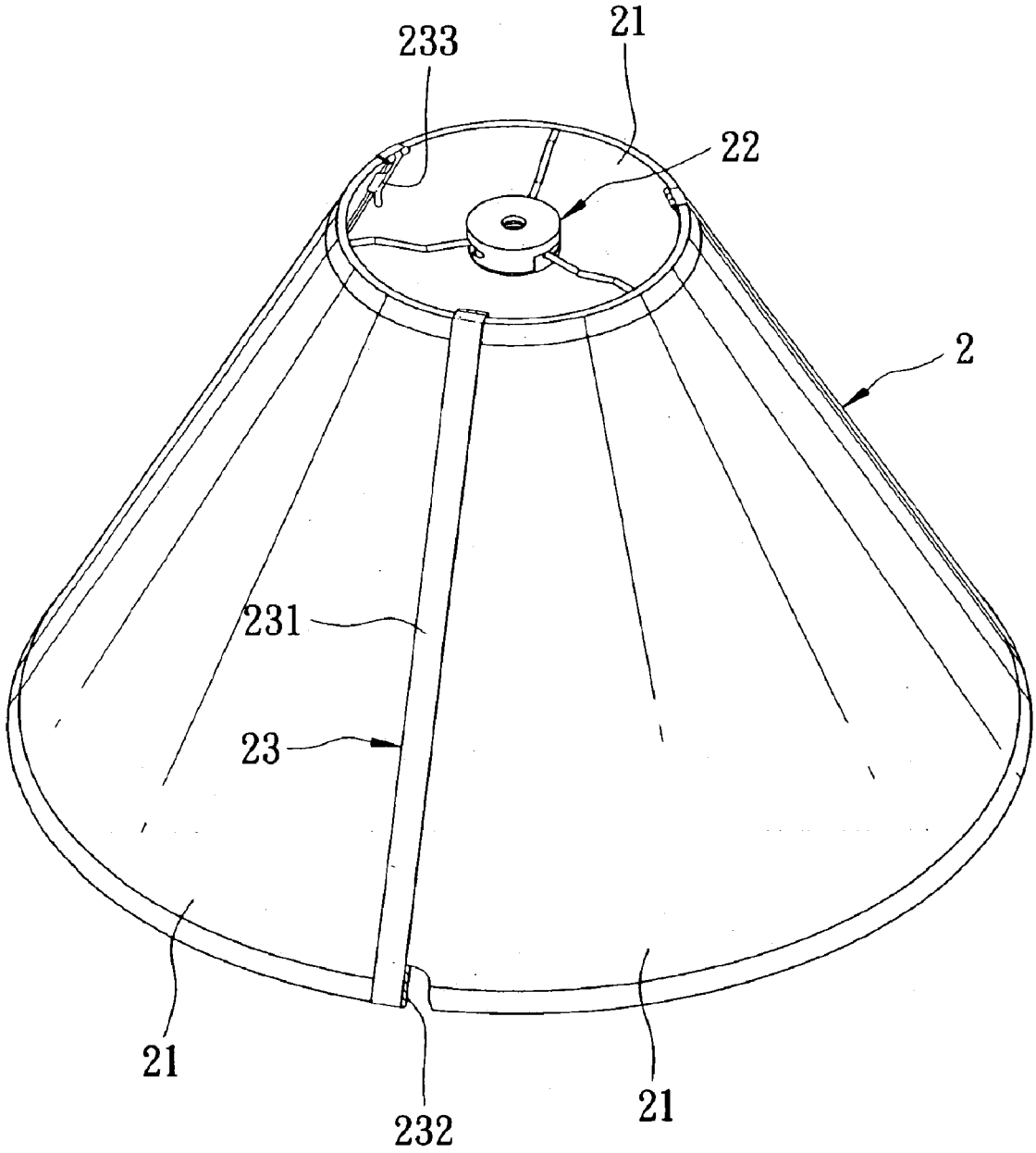
FIG. 2 PRIOR ART
FIG. 2 is a perspective view of another conventional lampshade assembly.
Figure 3:
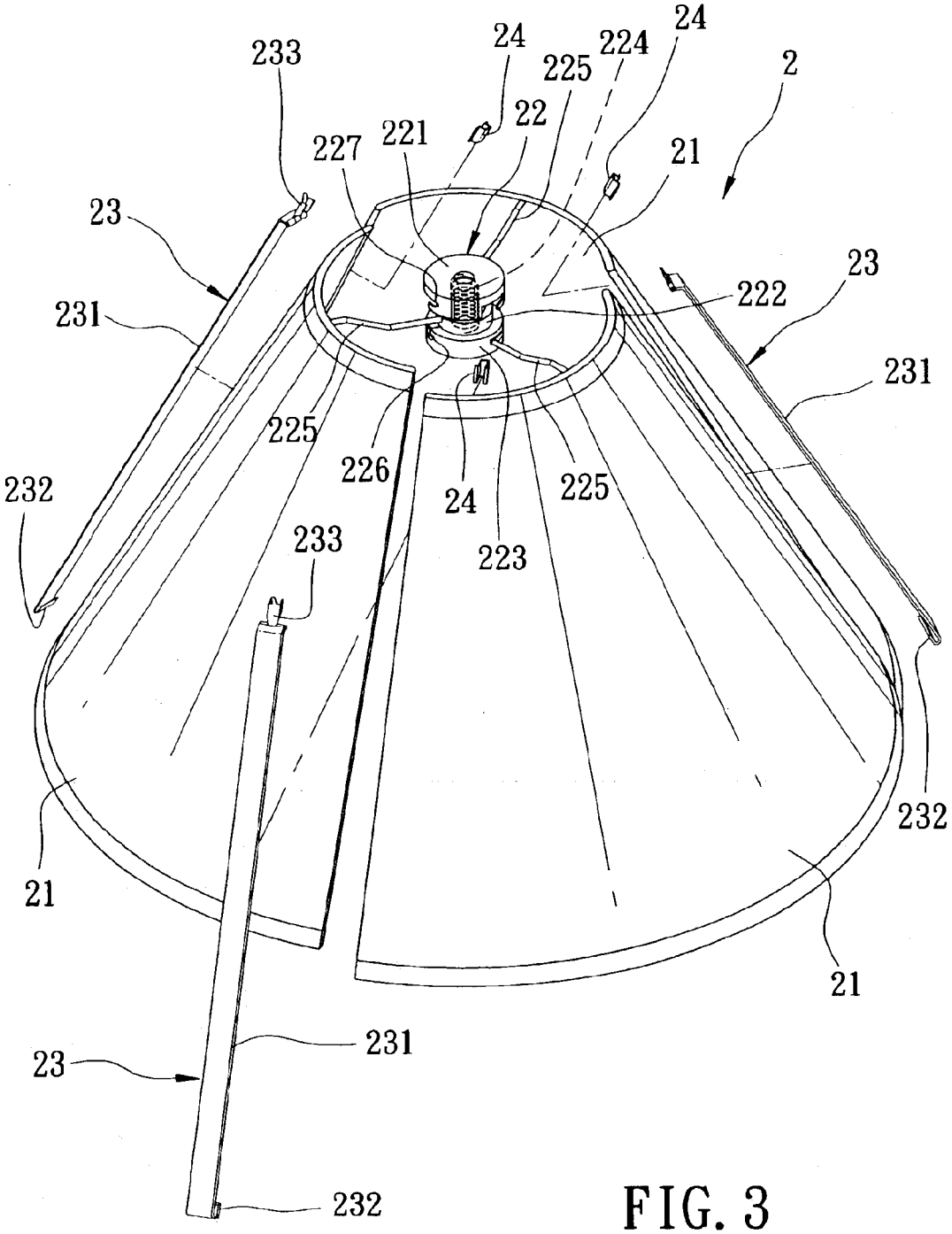
FIG. 3 PRIOR ART
FIG. 3 is an exploded perspective view of the conventional lampshade assembly of FIG. 2.
Figure 4:
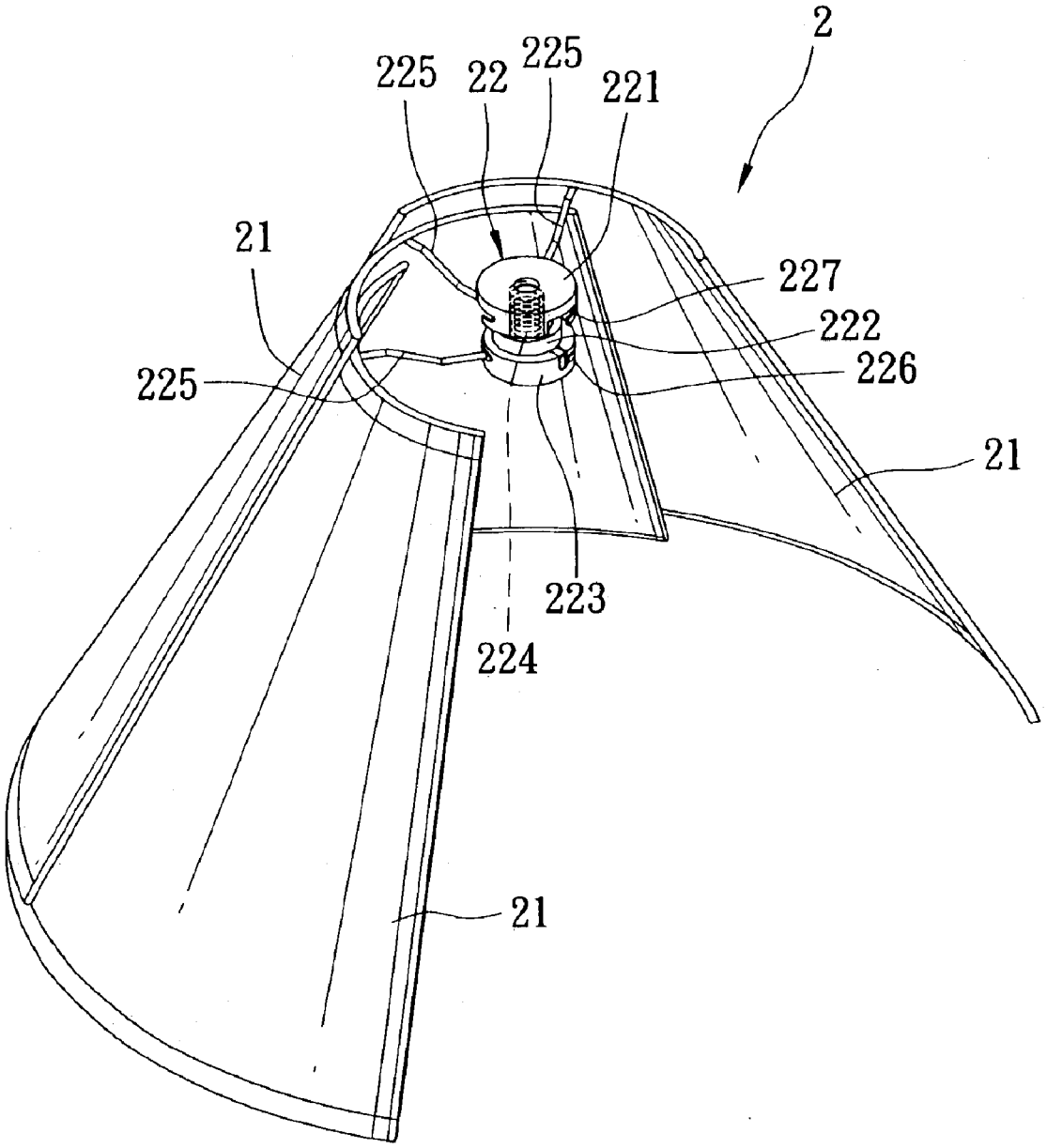
FIG. 4 PRIOR ART
FIG. 4 is a perspective view of the conventional lampshade assembly in a collapsed state.
Figure 5:
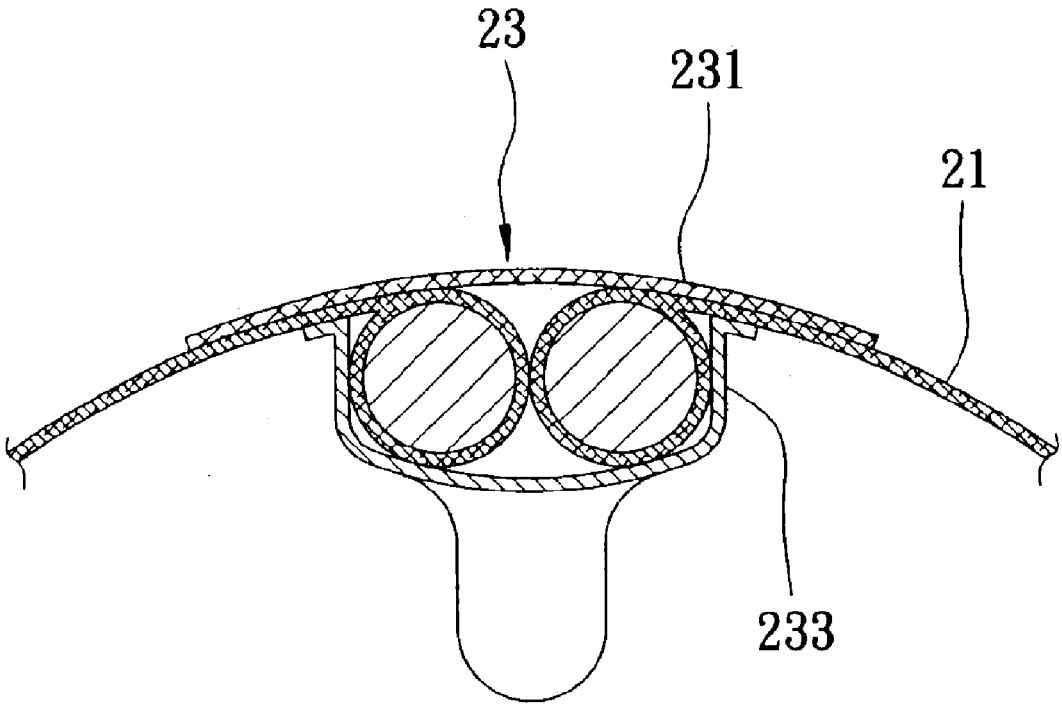
FIG. 5 PRIOR ART
FIG. 5 is a fragmentary sectional view of the conventional lampshade assembly of FIG. 2.
Figure 6:
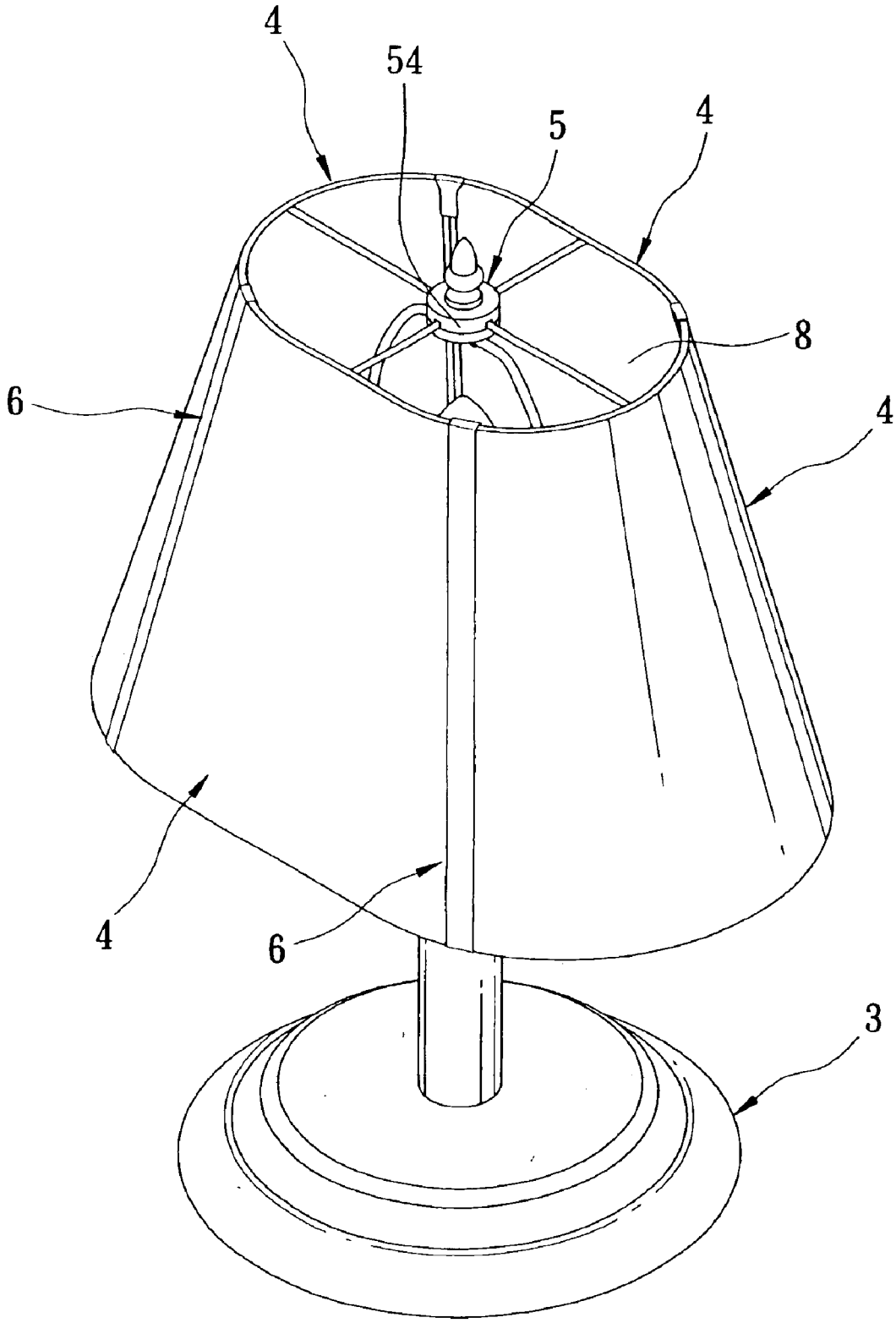
FIG. 6 is perspective view of a lamp that incorporates the first preferred embodiment of a lampshade assembly according to this invention.
Figure 7:
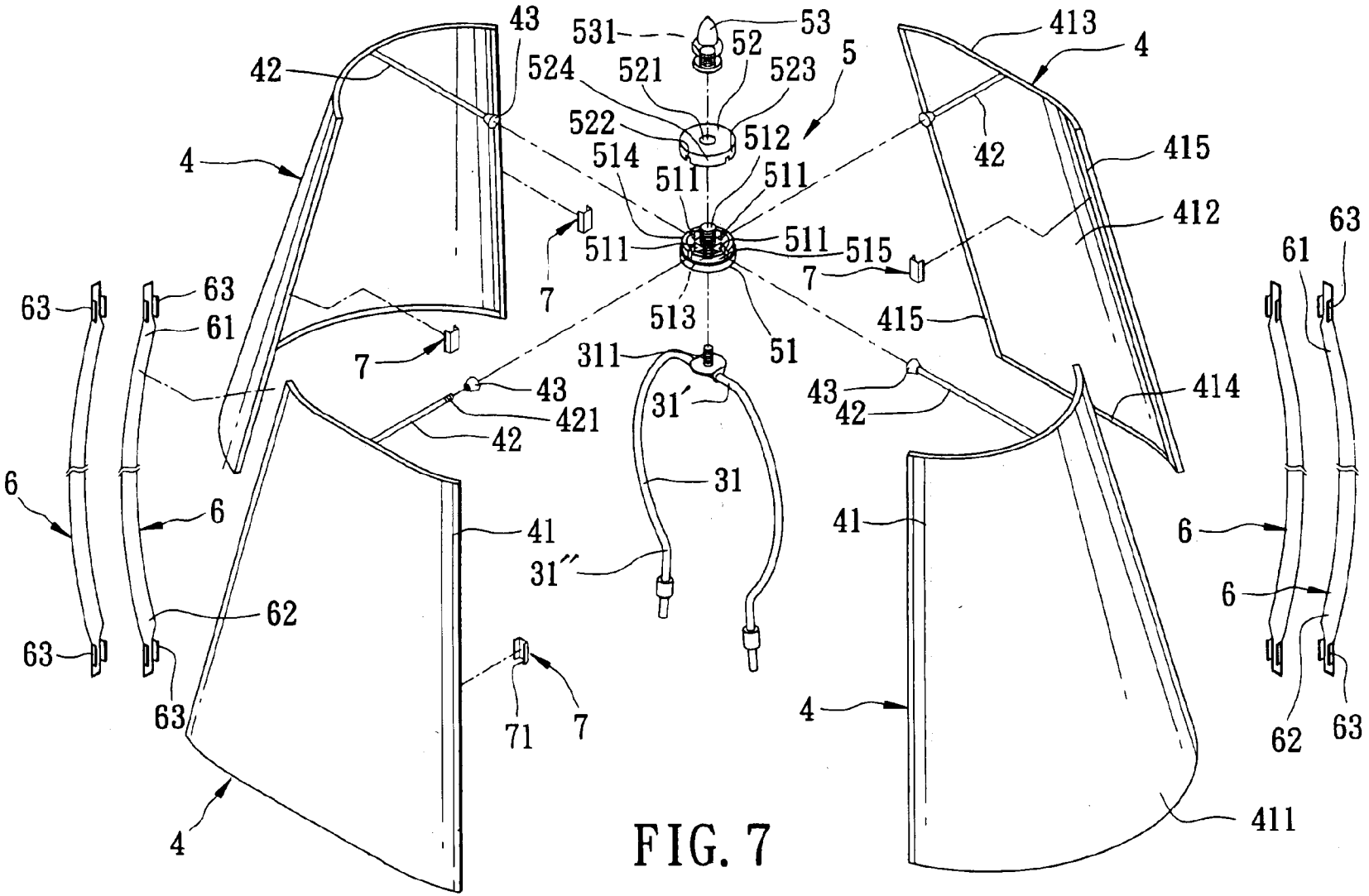
FIG. 7 is an exploded perspective view of the first preferred embodiment.
Figure 8:
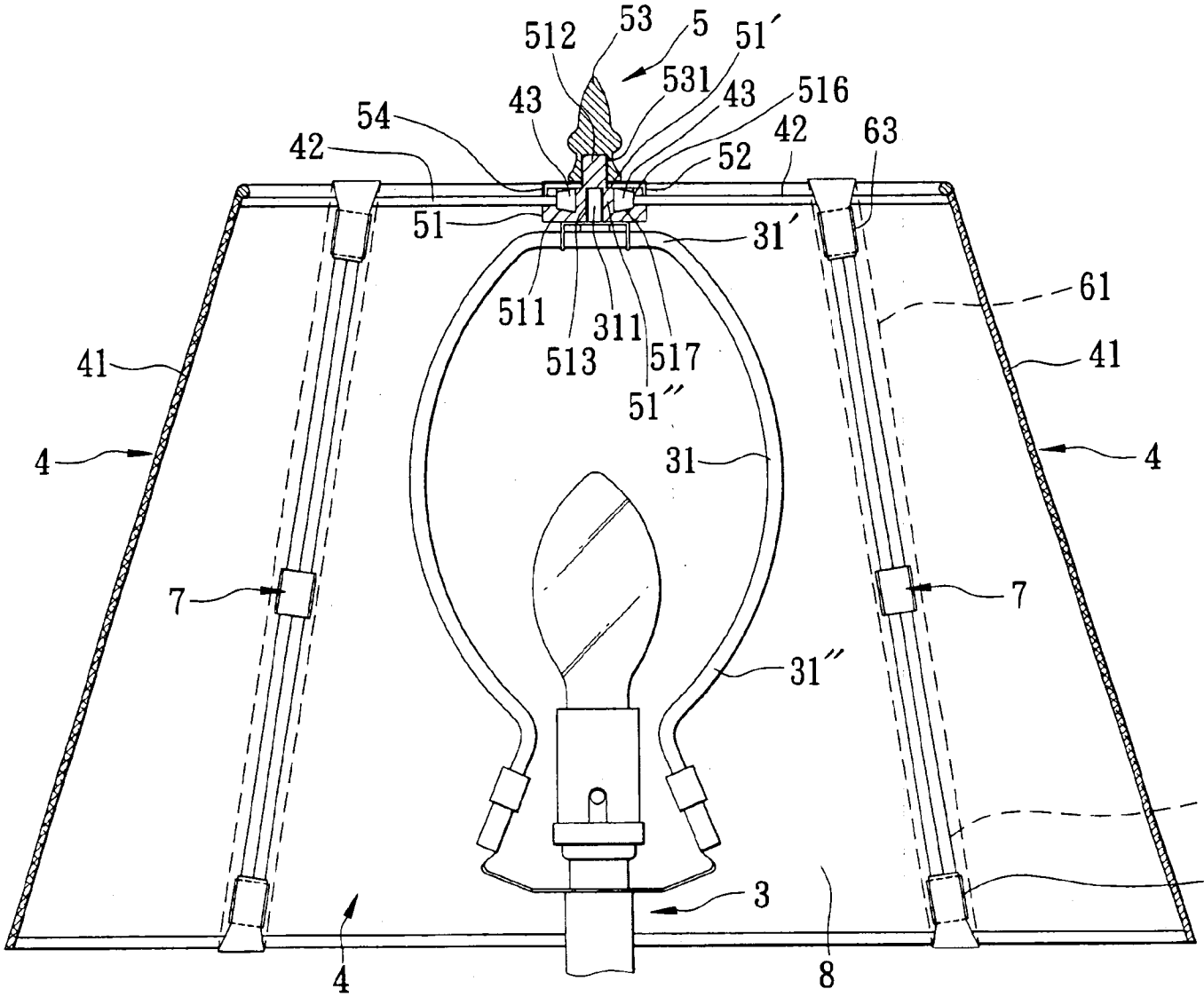
FIG. 8 is a partial sectional schematic view of the first preferred embodiment.

Referring to FIGS. 6, 7 and 8, the first preferred embodiment of a lampshade assembly according to this invention is shown to be mounted on a lamp base 3. The lampshade assembly includes a rib retaining unit 5, a plurality of shade members 4, a plurality of clip members 7, and a plurality of covering strips 6.

The rib retaining unit 5 includes a lower rib retaining member 51, an upper rib retaining member 52 superimposed on the lower rib retaining member 51, and a fastening member 53. The lower rib retaining member 51 is formed with a coupling post 512. The upper rib retaining member 52 is formed with a post hole 521 that permits the coupling post 512 to extend removably therethrough. The fastening member 53 engages removably the coupling post 512 for securing together the lower and upper rib retaining members 51,52. The rib retaining unit 5 has a periphery 54. In this embodiment, the lower rib retaining member 51 has one side 514 that confronts the upper rib retaining member 52 and that is formed with a plurality of lower anchoring units 515. The upper rib retaining member 52 has one side 523 that confronts the lower rib retaining member 51 and that is formed with a plurality of upper anchoring units 524. The lower anchoring units 515 of the lower rib retaining member 51 are disposed around the coupling post 512, are angularly spaced apart from each other, and configure the lower rib retaining member 51 with a plurality of lower anchoring groove portions 511. The upper anchoring units 524 of the upper rib retaining member 52 are angularly spaced apart from each other, and configure the upper rib retaining member 52 with a plurality of upper anchoring groove portions 522. The lower anchoring groove portions 511 cooperate with the upper anchoring groove portions 522 correspondingly to define a plurality of anchoring grooves 516 (best shown in FIG. 8) that extend in radial inward directions from the periphery 54 of the rib retaining unit 5 toward the coupling post 512. Preferably, the coupling post 512 is threaded externally, and the fastening member 53 is formed with an internal thread 531 for threadedly engaging the coupling post 512.

Each of the shade members 4 includes a shade body 41 formed from a looped frame wrapped with a fabric covering. Each of the shade members 4 has an outer side 411, an inner side 412 opposite to the outer side 411 in a first direction, an upper edge 413, a lower edge 414 opposite to the upper edge 413 in a second direction transverse to the first direction, and a pair of side edges 415 extending between the upper and lower edges 414,414 and opposite to each other in a third direction transverse to the first and second direction. Each of the shade members 4 further has a connecting rib 42 that extends in the first direction from the upper edge 413 at the inner side. The connecting rib 42 has a distal end 421 retained removably on the rib retaining unit 5 in a respective one of the anchoring grooves 516. Specifically, the distal end 421 of each of the connecting ribs 42 is provided with an enlarged anchoring block 43, which is screwed on the distal end 421 of each of the connecting ribs 42. Each of the anchoring grooves 516 has an enlarged end portion 517 disposed adjacent to the coupling post 512 and disposed to receive the anchoring block 43 on the distal end 421 of the respective one of the connecting ribs 42 therein.

The shade members 4 are disposed adjacent to each other. The inner sides 412 of the shade members 4 cooperate to form a lamp containing space 8 when the distal ends 421 of the connecting ribs 42 of the shade members 4 are retained on the rib retaining unit 5. In this preferred embodiment, the lamp containing space 8 formed by the shade members 4 has an elliptical shape.

Each of the clip members 7 interconnects removably the side edges 415 of an adjacent pair of the shade members 4 at the inner sides 412 of the adjacent pair of the shade members 4. Each of the clip members 7 is generally U-shaped and is formed with a clamping space 71 to engage the side edges 415 of the adjacent pair of the shade members 4 at the inner sides 412 of the adjacent pair of the shade members 4.

Each of the covering strips 6 is disposed on the outer sides 411 of an adjacent pair of the shade members 4 to conceal the side edges 415 of the adjacent pair of the shade members 4. Each of the covering strips 6 has upper and lower strip ends 61,62. The upper strip end 61 is foldable over the upper edges 413 of the adjacent pair of the shade members 4 and toward the inner sides 412 of the adjacent pair of the shade members 4. The lower strip end 62 is foldable under the lower edges 414 of the adjacent pair of the shade members 4 and toward the inner sides 412 of the adjacent pair of the shade members 4. Each of the upper and lower strip ends 61,62 is provided with a clip unit 63 that interconnects the side edges 415 of the adjacent pair of the shade members 4 at the inner sides 412 of the adjacent pair of the shade members 4. Each of the covering strips 6 is made of a flexible material.

Referring to FIG. 8, the lampshade assembly of the preferred embodiment further includes a mounting bracket 31 adapted to mount the rib retaining unit 5 on the lamp base 3. The lower rib retaining member 51 has a top side 51' formed with the coupling post 512, and a bottom side 51" formed with a threaded bore 513. The mounting bracket 31 has an upper end 31' provided with a threaded pole 311 for threadedly engaging the threaded bore 513, and a lower end 31" adapted to be retained on the lamp base 3.

During installation of the lampshade assembly, the enlarged anchoring block 43 of the connecting rib 42 of each of the shade members 4 is mounted in a corresponding one of the lower anchoring groove portions 511 of the lower rib retaining member 51. The upper rib retaining member 52 is then superimposed on the lower rib retaining member 51 so as to permit the coupling post 512 of the lower rib retaining member 51 to penetrate through the post hole 521 in the upper rib retaining member 52, to align the upper anchoring groove portions 522 of the upper rib retaining member 52 with the lower anchoring groove portions 511 of the lower rib retaining member 51, and to receive the anchoring block 43 of each of the connecting ribs 42 in the enlarged end portion 517 of a corresponding one of the anchoring grooves 516. The fastening member 53 is then threaded on the coupling post 512 so as to secure the lower and upper rib retaining members together. The covering strips 6 and the clip members 7 are sequentially mounted in a manner as described above. Finally, the upper end 31' of the mounting bracket 31 is threadedly engaged with the threaded bore 513 in the lower rib retaining member 51, and the lower end 31" of the mounting bracket 31 is retained on the lamp base 3.

Figure 9:
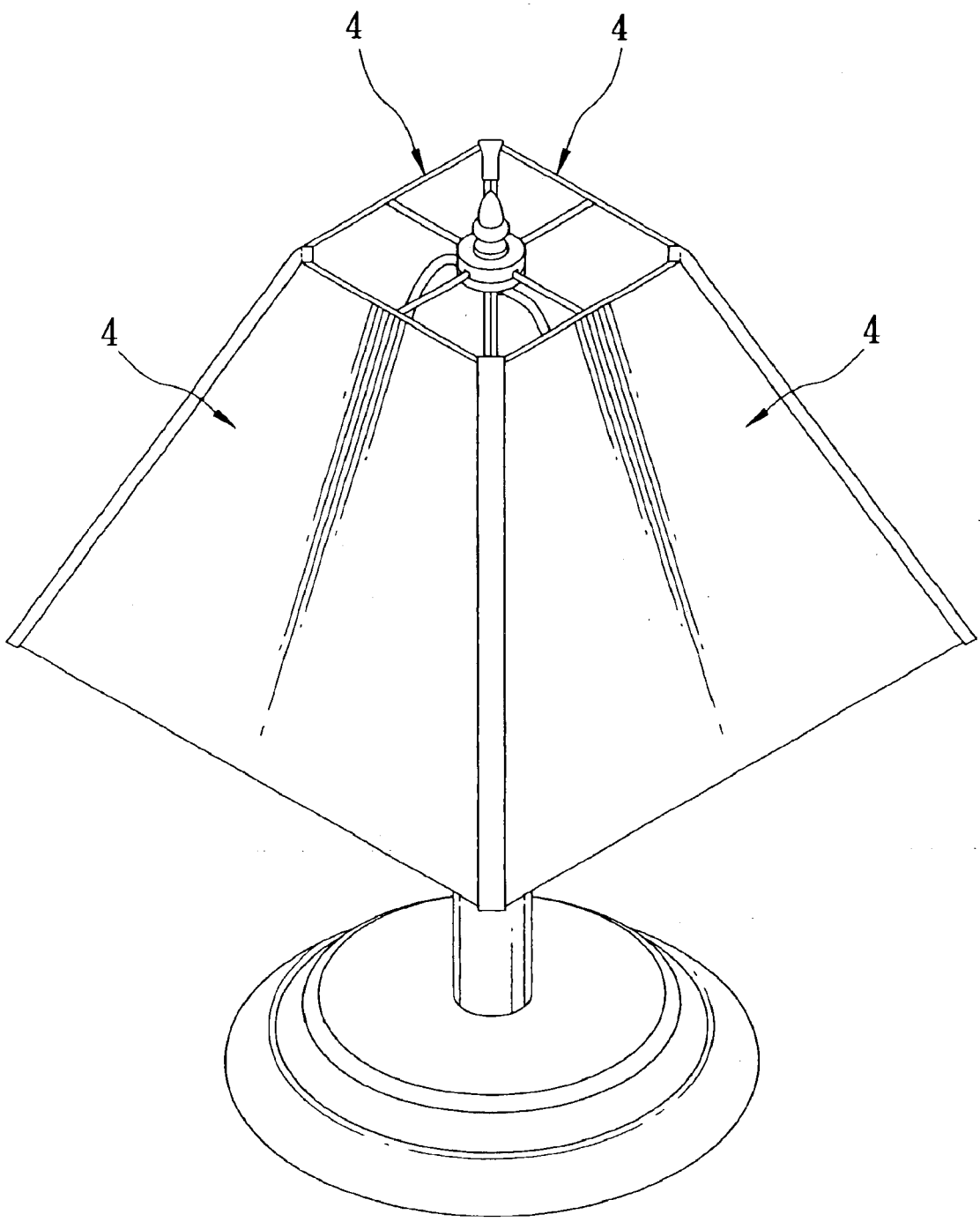
FIG. 9 is a perspective view of a lamp that incorporates the second preferred embodiment of the lampshade assembly according to this invention.

Referring to FIG. 9, the second preferred embodiment of this invention is shown to be similar to the first preferred embodiment, except that each of the shade members 4 has a rhombic shape.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A lampshade assembly comprising:

a rib retaining unit including a lower rib retaining member and an upper rib retaining member superimposed on said lower rib retaining member, one of said lower and upper rib retaining members being formed with a coupling post, the other of said lower and upper rib retaining members being formed with a post hole that permits said coupling post to extend removably therethrough, said rib retaining unit having a periphery, at least one of said lower and upper rib retaining members having one side that confronts the other of said lower and upper rib retaining members and that is formed with a plurality of anchoring units, said anchoring units being disposed around said coupling post, being angularly spaced apart from each other, and configuring said rib retaining unit with a plurality of anchoring grooves that extend in radial inward directions from said periphery of said rib retaining unit toward said coupling post, said rib retaining unit further including a fastening member that engages removably said coupling post for securing, together said lower and upper rib retaining members; and a plurality of shade members, each of which has an outer side, an inner side opposite to said outer side in a first direction, an upper edge, a lower edge opposite to said upper edge in a second direction transverse to the first direction, and a pair of side edges extending between said upper and lower edges and opposite to each other in a third direction transverse to the first and second directions, each of said shade members further having a connecting rib that extends in the first direction from said upper edge at said inner side, said connecting rib having a distal end retained removably on said rib retaining unit in a respective one of said anchoring grooves, said shade members being disposed adjacent to each other, and said inner sides of said shade members cooperating to form a lamp containing space when said distal ends of said connecting ribs of said shade members are retained on said rib retaining unit.

2. The lampshade assembly as claimed in claim 1, wherein said anchoring units are formed on each of said lower and upper rib retaining members such that said anchoring grooves are cooperatively confined by said lower and upper rib retaining members.

3. The lampshade assembly as claimed in claim 1, wherein said distal end of each of said connecting ribs is provided with an enlarged anchoring block, each of said anchoring grooves having an enlarged end portion disposed adjacent to said coupling post and disposed to receive said anchoring block on said distal end of the respective one of said connecting ribs therein.

4. The lampshade assembly as claimed in claim 1, wherein said coupling post is threaded externally, and said fastening member is formed with an internal thread for threadedly engaging said coupling post.

5. The lampshade assembly as claimed in claim 1, further comprising a plurality of clip members, each of which interconnects removably said side edges of an adjacent pair of said shade members at said inner sides of the adjacent pair of said shade members.

6. The lampshade assembly as claimed in claim 5, wherein each of said clip members is generally U-shaped and is formed with a clamping space to engage said side edges of the adjacent pair of said shade members at said inner sides of the adjacent pair of said shade members.

7. The lampshade assembly as claimed in claim 5, further comprising a plurality of covering strips, each of which is disposed on said outer sides of an adjacent pair of said shade members to conceal said side edges of the adjacent pair of said shade members.

8. The lampshade assembly as claimed in claim 7, wherein each of said covering strips has upper and lower strip ends, said upper strip end being foldable over said upper edges of the adjacent pair of said shade members and toward said inner sides of the adjacent pair of said shade members, said lower strip end being foldable under said lower edges of the adjacent pair of said shade members and toward said inner sides of the adjacent pair of said shade members, each of said upper and lower strip ends being provided with a clip unit that interconnects said side edges of the adjacent pair of said shade members at said inner sides of the adjacent pair of said shade members.

9. The lampshade assembly as claimed in claim 8, wherein each of said covering strips is made of a flexible material.

10. The lampshade assembly as claimed in claim 1, further comprising a mounting bracket adapted to mount said rib retaining unit on a lamp base.

11. The lampshade assembly as claimed in claim 10, wherein:

said lower rib retaining member has a top side formed with said coupling post, and a bottom side formed with a threaded bore;

said mounting bracket having an upper end provided with a threaded pole for threadedly engaging said threaded bore, and a lower end adapted to be retained on the lamp base.

* * * * *